United States Patent [19]

Murray, Jr.

[11] 4,223,686

[45] Sep. 23, 1980

[54] SMOKING APPARATUS WITH CAPILLARY TUBE PRESSURE BALANCE

[76] Inventor: Joseph E. Murray, Jr., 27 Alpine St., #14, Malden, Mass. 02148

[21] Appl. No.: 33,396

[22] Filed: Apr. 26, 1979

[51] Int. Cl.[3] ..... A24F 1/30

[52] U.S. Cl. ..... 131/173; 131/192

[58] Field of Search ..... 131/173, 192, 215 R, 131/223, 225

[56] References Cited

U.S. PATENT DOCUMENTS

| | | | |
|---|---|---|---|
| 1,249,984 | 12/1917 | Meissner | 131/173 |
| 2,475,472 | 7/1949 | Brown | 131/192 |
| 4,036,240 | 7/1977 | Murray, Jr. | 131/173 |

FOREIGN PATENT DOCUMENTS

| | | | |
|---|---|---|---|
| 1004068 | 11/1951 | France | 131/173 |

*Primary Examiner*—Stephen C. Pellegrino

*Attorney, Agent, or Firm*—Kenway & Jenney

[57] ABSTRACT

A smoking pipe having a pipe bowl with a smoke tube extending into a volume of filtering liquid in an enclosed reservoir. The shapes and dimensions of the smoke tube and liquid reservoir are selected in relation to the volume of liquid so that when the pipe is substantially upright, the end of the smoke tube extends into the liquid. A tubular pipe stem and associated valve extend from a reservoir port which is above the liquid top surface when the pipe is substantially upright. The physical characteristics of the smoke tube are related to the physical characteristics and volume of the filtering liquid and the shape and volume of the reservoir, so that when the pipe is inverted and the valve closes the passage through the pipe stem, there is substantially zero net force on a volume of liquid within the smoke tube due to the pressure differential across that volume, surface tensions between the liquid and the tube and gravitational force on that volume.

17 Claims, 11 Drawing Figures

SMOKING APPARATUS WITH CAPILLARY TUBE PRESSURE BALANCE

BACKGROUND OF THE INVENTION

This invention relates to an apparatus for smoking and more particularly to pipes having a liquid filtering agent.

There are many types of pipes in the prior art which have a pipe bowl, a liquid filtering agent in a closed reservoir, a smoke tube extending from the pipe bowl to a point in the reservoir and below the top surface of the filtering agent, and a stem extending from a point in the reservoir and above the top surface of the filtering agent to the user. In operation, smoke passes from the bowl through the smoke tube, through a portion of the filtering agent, through a portion of the reservoir above the top surface of the filtering agent, and through the stem to the user. The advantages of such pipes are well known, and include removal of toxic substances from the smoke and cooling of the smoke. However, the prior art pipes generally suffer from the problem of leakage of the liquid filtering agent from the reservoir into either the smoke tube or the stem, or both, while the pipe is oriented in positions other than its normal upright position. This problem of leakage under various pipe orientations is of particular concern in compact, portable pipes which are intended to be easily carried about by the smoker when not in use. Non-upright orientation and subsequent leakage may also occur when the pipe bowl is being emptied of ashes or otherwise cleaned, or when tobacco is being added to the bowl by scooping into a tobacco pouch.

There have been some attempts to the solution of this leakage problem. One approach to this problem is described in the present applicant's U.S. Pat. No. 4,036,240 which discloses a pipe having a leak resistant filter cartridge with a dual concentric smoke tube arrangement protruding into the reservoir. The geometry of the tubes is selected with respect to the volume of liquid placed within the cartridge to minimize leakage. However, it is possible that under certain conditions, e.g. due to splashing, some of the filtering agent may enter the smoke tubes and escape from the reservoir.

Another prior art approach to this leakage problem utilizes gravitationally controlled ball valves as disclosed in U.S. Pat. No. 3,315,687 wherein these gravity valves are intended to prevent leakage from both the smoke tube and the stem. In actual use, this approach is not practical because, if the smoking apparatus is of reasonable size, the gravity controlled balls are necessarily of relatively low mass which results in very low forces acting on them. These low forces produce very unreliable sealing at the valves under normal usage conditions. In addition, because the balls are located in the smoke path, they quickly become coated with sticky smoke condensates which soon prevent motion of the balls.

It is the object of the present invention to provide a portable smoking apparatus having a liquid filtering agent in a reservoir, wherein the apparatus can be made more compact and substantially immune to leakage of the filtering agent while being transported, or being filled with tobacco, or being emptied of ashes, regardless of its orientation.

SUMMARY OF THE INVENTION

Briefly, the present invention includes a pipe bowl coupled to a body member where the body member encloses a region adapted to house a predetermined volume of filtering liquid. The pipe bowl includes a smoke tube extending into the filtering liquid reservoir. The shapes and dimensions of the smoke tube and liquid reservoir are selected in relation to the volume of liquid so that when the pipe is substantially upright, the end of the smoke tube extends into the liquid.

The liquid reservoir further includes a reservoir port at a point above the upper surface of the liquid when the pipe is substantially upright. A pipe stem and associated valve are selectively adapted in a first position to provide a smoke path from the region exterior to the pipe by way of the stem interior and reservoir part, to the interior region of the filtering liquid reservoir. In a second position, the stem and associated valve are adapted to close this smoke path.

The physical characteristics of the smoke tube are related to the physical characteristics and volume of the filtering liquid and the shape and volume of the reservoir, so that at normal atmospheric pressure exterior to the pipe and when the pipe is inverted and the valve is in its second position there is substantially zero net force on a volume of liquid within the smoke tube due to the pressure differential across that volume, surface tensions between the liquid and the tube and gravitational force on that volume. As a result, with this configuration, any liquid within the smoke tube automatically remains substantially stationary with respect to the tube, or at least within the tube (thereby preventing leakage from the tube), due to the effective pressure-gravity balance within the capillary region of the smoke tube.

BRIEF DESCRIPTION OF THE DRAWINGS

The foregoing and other objects of this invention, the various features thereof, as well as the invention itself, may be more fully understood from the following description, when read together with the accompanying drawings in which.

DESCRIPTION OF THE PREFERRED EMBODIMENT

Figures 1, 2:
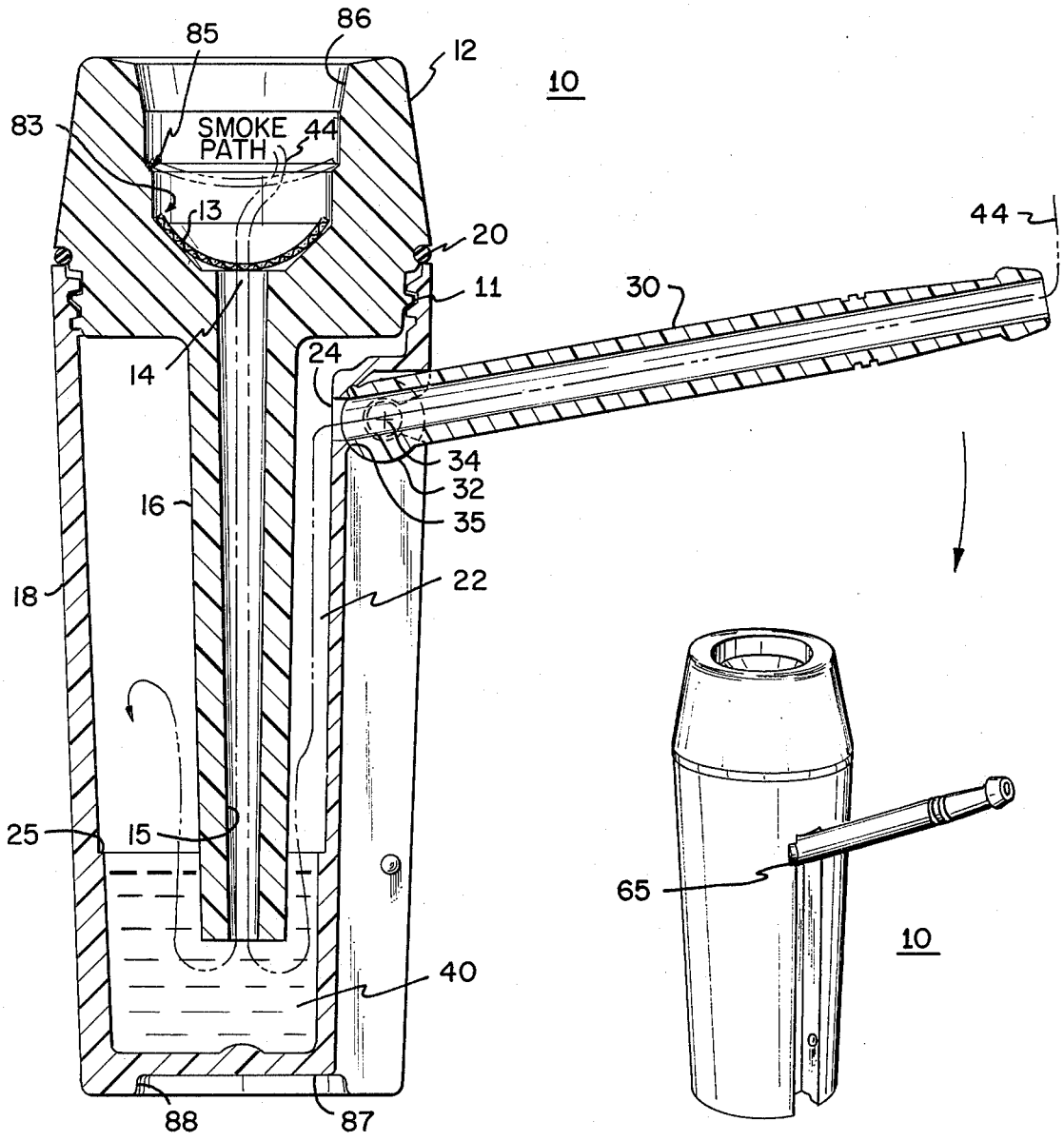
FIG. 1 shows a sectional view of an exemplary smoking apparatus in accordance with the present invention.
FIG. 2 shows a perspective view of the smoking apparatus of FIG. 1.

FIGS. 1 and 2 show an embodiment 10 of the present invention in sectional and perspective views, respectively. Pipe 10 includes a pipe bowl 12 having a screen 13 disposed across a smoke port 14. The base of bowl 12 includes an upper cylindrical surface 86, an upper screen support ridge 85, and a lower cylindrical surface 83. This configuration allows the placement of a screen 13 at either a shallow position or a deep position. That is, screen 13 may be positioned against surface 86 at ridge 85, or alternatively, screen 13 may be pushed to the bottom of bowl 12 at surface 83. In alternative embodiments multiple ridges could be used to provide more screen positions. In still other embodiments, the bore of bowl 12 may not include any such ridges.

A smoke tube 16 has an interior surface 15 which extends downward from smoke port 14 of bowl 12. Pipe body 18 is joined to the bowl 12 by a threaded connection 11 and a sealing O-ring 20 to form a reservoir region 22 interior to the sidewalls of the body 18. The pipe body 18 further includes a reservoir port 24 near its upper end and a fill level indicator step 25 around its sidewalls. Reservoir 22 contains a filtering liquid 40 having a top surface above the end of tube 16 and below the reservoir port 24.

In the present embodiment, bowl 12 is a high heat resistant thermosetting plastic which is impervious to the filtering liquid 40.

Figure 8:
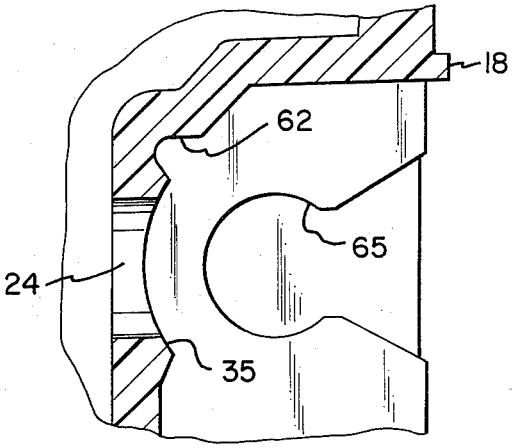
FIG. 8 shows in detailed sectional view, a portion of the body of the smoking apparatus of FIG. 1.

In the present embodiment a tubular pipe stem 30 has a pivoting valve configuration (shown in detailed form in FIGS. 3 and 4) at one end which is coupled to body 18 at the reservoir port 24 (shown in detailed form in FIG. 8). The valve configuration consists of a cylindrical surface 32 which pivots about axis 34 and engages a complementary sealing surface 35 of pipe body 18. By way of example, the body 18 may be made of a resilient plastic material such as polyethylene. The stem 30 includes two pivots coaxial with axis 34 which are adapted to snap-fit into corresponding pivot supports (denoted by reference designation 65 in FIGS. 2 and 8) in body 18. With this configuration, a smoke path is established between the interior region of stem 30 through port 24 to the reservoir region 22 of body 18 when the stem is oriented as illustrated in FIGS. 1 and 2. This smoke path is cut off at port 24 when stem 30 is pivoted downward so that the stem interior is no longer aligned with the port 24 (i.e. when surfaces 32 and 35 effectively seal off port 24.

Figure 1A:
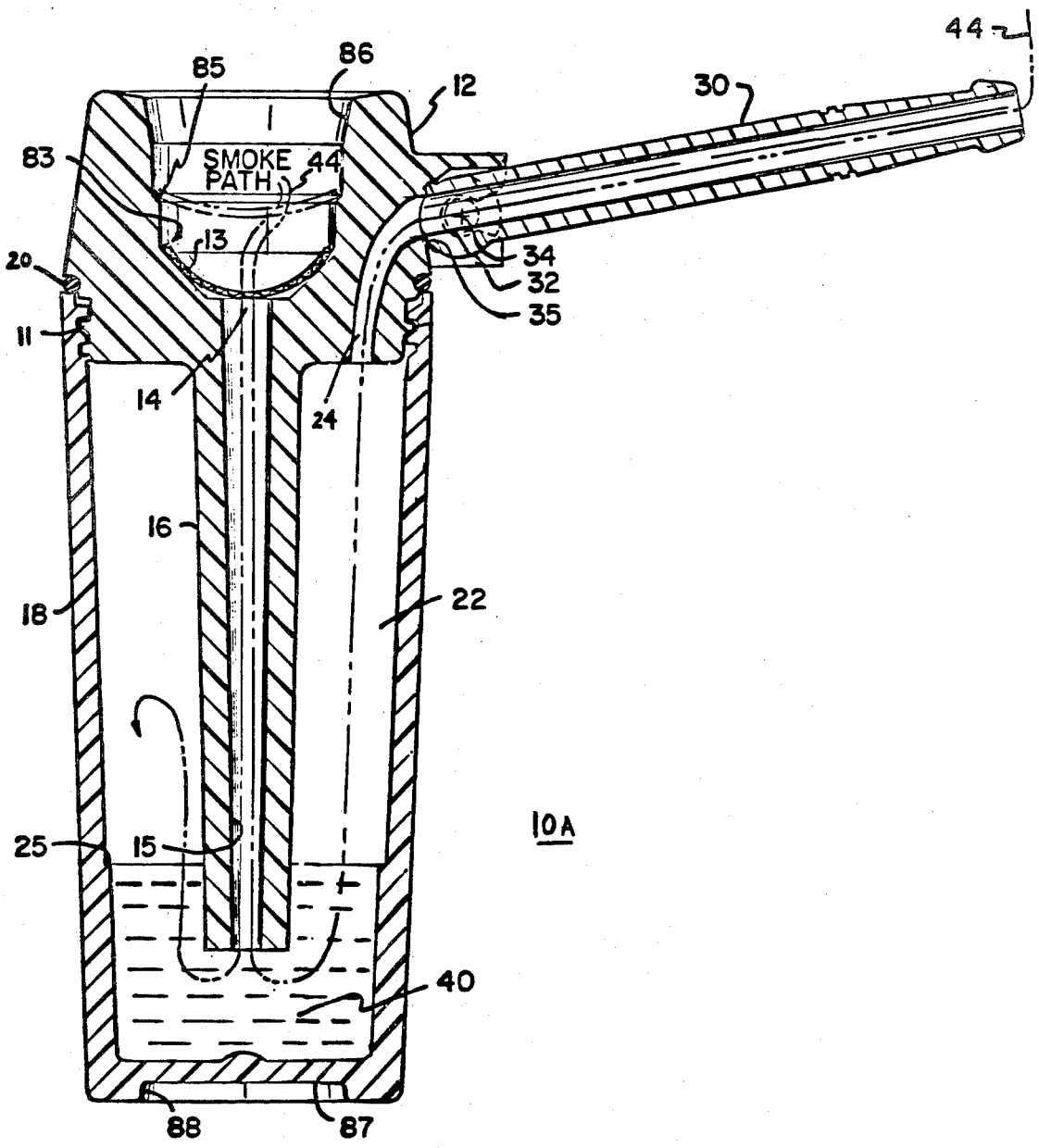
FIG. 1A shows a sectional view of an alternate embodiment of the present invention.

In other alternative embodiments the reservoir port 24, valve 32 and stem 30 may be attached to or integral with the pipe bowl 12 as shown in the exemplary embodiment 10A of FIG. 1A. The pipe 10A is similar to pipe 10 of FIGS. 1 and 2, except that the stem 30 and its pivoting valve configuration are connected directly to bowl 12, at port 24 (which is in the form of an elongated passage through bowl 12).

In this configuration, with pipe 10 in a substantially vertical position with stem 30 oriented as shown in FIG. 1, a smoke path 44 is established from bowl 12, through the interior region of tube 16, a portion of the filtering liquid 40, the reservoir port 24 and the interior of stem 30 to a user.

With stem 30 rotated clockwise from the illustrated (or open) position so that reservoir port 24 is closed, the smoke path 44 is interrupted. Because of the sealing action at port 24, there may be no leakage of liquid 40 into stem 30 regardless of the orientation of pipe 10. Furthermore, as described more fully below, the size, shape, and surface characteristics of interior surface 15 of tube 16 are related to the physical characteristics and volume of liquid 40, the volume of reservoir 22, and the pressure exterior to pipe 10 such that there may be no leakage by way of smoke tube 16 either.

Figure 3:
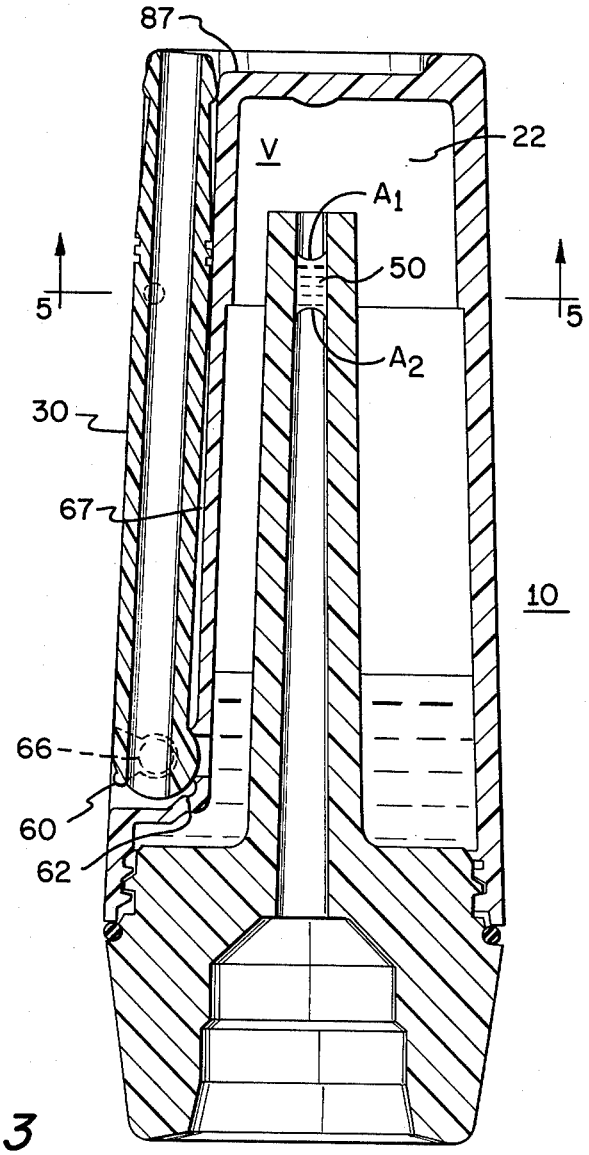
FIG. 3 illustrates the operation of the smoking apparatus of FIG. 1.

FIG. 3 illustrates pipe 10 in an inverted position with the pipe stem in its closed position so that reservoir port 24 is sealed. In order to ensure that none of liquid 40 may escape from tube 16 even if splashed into that tube, the size, shape, and surface characteristics of the interior surface 15 of tube 16 are related to the physical characteristics and volume of liquid 40, the volume of reservoir 22, and the pressure exterior to pipe 10 such that any splashed liquid is maintained in tube 16 by a capillary tube-pressure balance effect. That is, a volume of liquid 50 (illustrated in FIG. 3) which may somehow enter tube 16 is balanced within that tube by gravitational and surface tension forces and the pressure differential across that volume of liquid 50 in tube 16. For example, in the present embodiment, the volume of the region of the reservoir 22 above the surface of liquid 40 is denoted by V, the surface areas of the volume of liquid 50 in the tube 16 are denoted by $A_1$ (at the upper end in FIG. 3) and $A_2$ (lower end), respectively, the weight of the liquid 50 is denoted as W, the gas pressure within the reservoir 22 is denoted as $P_1$, and the air pressure exterior to the pipe 10 is denoted as $P_2$ (atmospheric). Furthermore, in the present embodiment the inner diameter of tube 16 is small enough to produce interfacial tension forces between the liquid volume 50 and the tube interior surface 15, which, when combined with the intermolecular surface tension forces within the liquid volume 50, are large enough to prevent the passage of air past liquid volume 50. As the volume of liquid 50 in the tube begins to descend in the tube 16 due to gravity, the volume V increases and $P_1$ drops until equilibrium is reached, at which point:

$$P_2A_2-P_1A_1=W$$

The relationship between change in V and $P_1$ approximates:

$$P_1=(MRT/V)$$

where T is temperature, M is mass of the gas, and R is the gas constant.

In the present embodiment, where the temperature is approximately constant, the gas is air, and the reservoir volume V is relatively small, at atmospheric pressure outside pipe 10, a very small increase in volume V will produce the pressure differential, $P_2-P_1$, needed to balance the weight W of liquid volume 50. Therefore, the volume of liquid 50 will only move down tube 16 a small distance before equilibrium is reached, thereby preventing any of liquid 40 from escaping through tube 16. With other configurations of tube 16, and alternative liquid agents, conditions where $P_1$ cannot be equalized by the passage of air past the liquid volume 50 in tube 16 may be established by adjusting the size, shape, and surface characteristics of the interior region of tube 16. These conditions are produced by interior tube configurations which provide large surface tension forces relative to the unsupported surface areas of liquids contained within these tubes. Examples of such interior configurations would include circular shapes with small diameters (such as capillary tubes) or rectangular slots with at least one small dimension.

In the present embodiment the smoke tube 16 has an inner diameter of 2.5 millimeters and a length of 65 millimeters, the reservoir has a volume of 30 cubic centimeters and the liquid 40 is 10 cubic centimeters of water. Alternative dimensions and volumes may readily be utilized in keeping with the present invention in order to achieve the capillary tube pressure balance operation.

Figure 5:
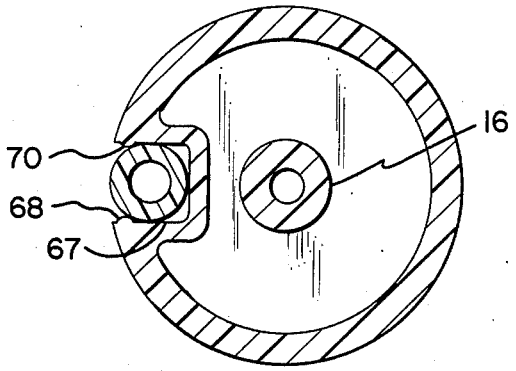
FIG. 5 shows in section view, the body of the smoking apparatus of FIG. 3.
Figure 4:
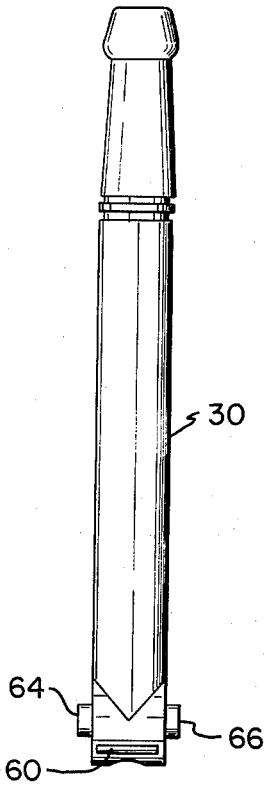
FIG. 4 shows a side view of the stem of the smoking apparatus of FIG. 3.

The stem 30 of FIG. 3 is shown in side view in FIG. 4 and includes a bump 60 adapted to mate with a corresponding detent 62 in body 18 in order to hold stem 30 in the open position illustrated in FIGS. 1 and 2. FIG. 4 also shows the pivots 64 and 66 which pivotally support stem 30 in body 18. FIG. 5 shows a sectional view of the pipe 10 of FIG. 3. The recess 67 in body 18 provides a space for the compact storage of stem 30 when in the closed position. Recess 67 includes bumps 68 and 70 which frictionally engage stem 30 at an angular position intermediate of the open and closed positions. With this configuration,the bumps 68 and 70 hold the stem in its closed position.

Figure 6:
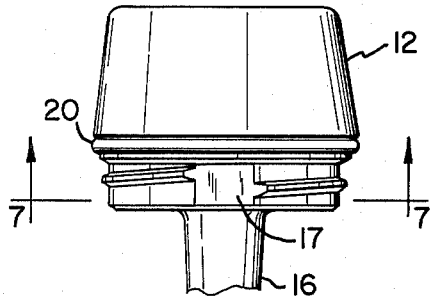
FIG. 6 shows a side view of the bowl member of the smoking apparatus of FIG. 1.
Figure 7:
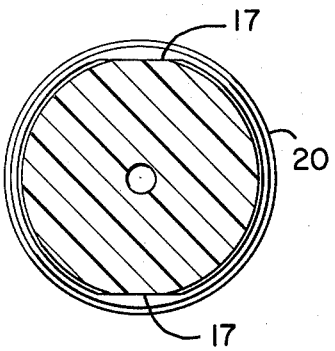
FIG. 7 shows a sectional view of the bowl member of FIG. 6.

FIG. 6 shows pipe bowl 12 and O-ring 20 uncoupled from pipe body 18 to illustrate air vents which extend through a portion of threaded connection 11. FIG. 7 shows a sectional view of bowl 12 and the air vents. As shown, the threaded portion of the base of bowl 12 include thread segments which are interrupted at the flat portions denoted by reference designation 17. These portions establish the air vents hereafter denoted as air vents 17. As a consequence of these vents, during coupling of bowl 12 to body 18, no air-tight seal is established until O-ring 20 seats against the top edge of body 18. Without these vents 17, the gas in reservoir 22 above liquid 40 can be slightly compressed during the coupling of bowl 12 to body 18 if stem 30 is in the closed position where reservoir port 24 is sealed. If the gas pressure in reservoir 22 increases above atmospheric pressure, liquid 40 can be forced up smoke tube 16, through smoke port 14 and into the bore of bowl 12. This wetting of the bowl bore and the tobacco within it is prevented by the pressure release path established by air vents 17. In alternative embodiments, the air vent may be formed by flat portions on the threaded portion of the sidewalls of the body 18, or on both that portion and the portion of the base of bowl 12 as shown in FIGS. 6 and 7. Although the use of the O-ring 20 is preferred to seal the bowl to the body, in any of these embodiments, the O-ring 20 may be eliminated provided the flat portions extend only partially along the length of the tips of the threaded portions, but sufficiently far to avoid the problem of excessive pressure build-up in the reservoir.

FIG. 8 shows a partial sectional view of body 18 illustrating pivot support 65 which is adapted to receive stem pivot 64 by a snap-fit assembly. FIG. 8 also shows detent 62 for holding bump 60, reservoir port 24, and sealing surface 35 for mating with cylindrical surface 32 of stem 30.

Figure 10:
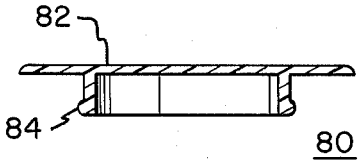
FIGS. 9 and 10 show in plan and sectional views, respectively, a cap member for the apparatus of FIG. 1.
Figure 9:
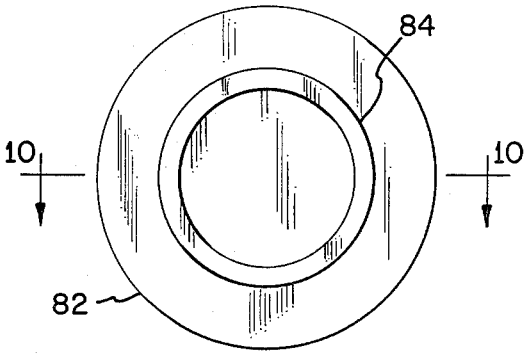

FIGS. 9 and 10 show a cap member 80 which may be utilized in conjunction with the present embodiment. The cap member 80 may be a resilient plastic (such as polyethylene) and includes a substantially planar portion 82 and a substantially cylindrical portion 84. To accommodate the cap member 80, the upper cylindrical surface 86 of bowl 12 (shown in FIG. 1) is adapted so that portion 84 fits snugly therein. In addition, body 18 has a bottom recess 87 (shown in FIG. 1) which provides a cylindrical surface 88 (shown in FIG. 1) also adapted so that portion 84 fits snugly therein. With this configuration, the cap member 80 may be used for bowl 12 when the pipe is not in use, or conveniently stored at the base of body 18 when the pipe is in use. Furthermore, as shown in FIG. 3, bottom recess 87 provides access to stem 30 so that it may be easily pushed from the closed position to the open position.

In the illustrated embodiment, the valve at reservoir port 24 is integral with the pivoting coupling of stem 30 to body 18. In alternative embodiments, a separate valve may be utilized in conjunction with either a stationary stem or a movable stem. Such a valve may be positioned, for example, anywhere along the stem.

In the illustrated embodiment, the stem 30 and valve assembly are recessed into the sidewalls of body 18 and the seal between the interior of stem 30 and region 22 is directly provided by adjacent surfaces of stem 30 and body 18. In alternative embodiments, the stem 30 may be completely external to body 18 and a separate sealing member with resilient and/or lubricated surfaces may be used between the interior of stem 30 and region 22.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claim are therefore intended to be embraced therein.

I claim:

1. A smoking apparatus comprising:

A. a pipe bowl including a means for supporting smoking material and a base portion with smoke port having a smoke tube extending therefrom, B. a pipe body having sidewalls extending from a bottom member, and means for coupling said sidewalls to said base portion to enclose a region interior to said sidewalls establishing a reservoir whereby said smoke tube extends into said reservoir, said body being adapted to house a predetermined volume of liquid in said reservoir such that the upper surface of said liquid is above the end of said smoke tube when said apparatus is substantially upright, C. a reservoir port means for establishing a port in said reservoir at a point above the upper surface of said liquid when said apparatus is substantially upright, D. a tubular pipe stem and associated valve means, said associated valve means being selectively adapted in a first position to establish a smoke path connecting the region exterior to said pipe by way of said stem interior and said reservoir port to said reservoir, and adapted in a second position to seal off said smoke path, wherein the size, shape, and surface characteristics of the interior of said smoke tube are related to the physical characteristics and volume of said liquid, the volume of said reservoir, and the pressure exterior to saidapparatus, such that forces on a volume of liquid interior to said smoke tube due to surface tensions of the liquid within the smoke tube and the pressure differential across said volume balance the gravitational force on said volume when said valve means is in said second position.

2. A smoking apparatus according to claim 1 wherein said pipe stem is pivotably coupled to said reservoir port means and is pivotable between a first angular orientation which establishes said valve means in said first position, and a second angular orientation which establishes said valve means in said second position.

3. A smoking apparatus according to claim 1 wherein said valve means is intermediate of said reservoir port and said pipe stem.

4. A smoking apparatus according to claim 1 wherein said reservoir port means establishes said reservoir port in said pipe bowl, and wherein said pipe stem and associated valve means are coupled to said pipe bowl.

5. A smoking apparatus according to claim 4 wherein said valve means is intermediate of said reservoir port and said pipe stem.

6. A smoking apparatus according to claim 1 wherein said reservoir port means establishes said reservoir port in said sidewalls, and wherein said pipe stem and associated valve means are coupled to said sidewalls.

7. A smoking apparatus according to claims 2 or 4 or 6 wherein said valve means includes a concave cylindrical surface surrounding the outer side of said reservoir port and further includes a portion of said pipe stem having a convex cylindrical surface with substantially the same radius of curvature as said concave cylindrical surface and surrounding one end of the interior region of said pipe stem, and further includes a coupling means for coupling said pipe stem portion to said reservoir port means whereby said concave and convex cylindrical surfaces are substantially coaxial and said pipe stem portion is pivotable between said first position where said pipe stem interior overlaps said reservoir port and said second position where said pipe stem interior and said reservoir port are non-overlapping.

8. A smoking apparatus according to claim 7 wherein said pipe stem and said body include means for frictionally engaging one end of said pipe stem when said pipe stem is at a predetermined orientation intermediate of said first and second positions.

9. A smoking apparatus according to claim 7 wherein said pipe stem includes means for selectively locking said pipe stem in said first position.

10. A smoking apparatus according to claim 6 wherein said valve means is intermediate of said reservoir port and said pipe stem.

11. A smoking apparatus according to claim 1 wherein said sidewall-to-base portion coupling means comprises:

a threaded base member extending from said base portion, a threaded body member extending from said sidewalls and adapted for threaded connection with said threaded base member, wherein said threaded members include one or more vent portions interrupting the thread segments thereof.

12. A smoking apparatus according to claim 11 wherein said vent portions extend the full length of the said threaded base member, and wherein said coupling means further comprises a sealing member adapted for sealing said vent portions when said threaded body member and said threaded base member are fully connected.

13. A smoking apparatus according to claim 11 wherein said vent portions extend the full length of the said threaded body member, and wherein said coupling means further comprises a sealing member adapted for sealing said vent portions when said threaded body member and said threaded base member are fully connected.

14. A smoking apparatus according to claim 11 wherein said vent portions extend the full length of the said threaded base member and said body member, and wherein said coupling means further comprises a sealing member adapted for sealing said vent portions when said threaded body member and said threaded base member are fully connected.

15. A smoking apparatus according to claim 11 wherein said vent portions extend from the tip of and less than the full length of said threaded base member, and wherein said coupling means includes portions of said threaded base and body members adapted for sealing said vent portions when said threaded body member and said threaded base member are fully connected.

16. A smoking apparatus according to claim 11 wherein said vent portions extend from the tip of and less than the full length of said threaded body member, and wherein said coupling means includes portions of said threaded base and body members adapted for sealing said vent portions when said threaded body member and said threaded base member are fully connected.

17. A smoking apparatus according to claim 11 wherein said vent portions extend from the tip of and less than the full length of said threaded base member and said body member, and wherein said coupling means includes portions of said threaded base and body members adapted for sealing said vent portions when said threaded body member and said threaded base member are fully connected.

* * * * *